US007198102B2

(12) United States Patent
Virally et al.

(10) Patent No.: US 7,198,102 B2
(45) Date of Patent: Apr. 3, 2007

(54) AUTOMATIC DOWNLINK SYSTEM

(75) Inventors: Stephane J. Virally, Sugar Land, TX (US); Christopher P. Reed, West University Place, TX (US); John A. Thomas, Porter, TX (US); Franck Al Shakarchi, Deir ez Zor (SY); Remi Hutin, New Ulm, TX (US); Jean-Marc Follini, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/299,154

(22) Filed: Dec. 9, 2005

(65) Prior Publication Data

US 2006/0102340 A1 May 18, 2006

Related U.S. Application Data

(62) Division of application No. 10/605,248, filed on Sep. 17, 2003.

(51) Int. Cl.
*E21B 43/00* (2006.01)

(52) U.S. Cl. ..... 166/249

(58) Field of Classification Search ..... 175/40–48; 367/81–85

See application file for complete search history.

(56) References Cited

U.S. PATENT DOCUMENTS 3,461,978 A 8/1969 Whittle
3,800,277 A 3/1974 Patton et al.
3,863,203 A 1/1975 Patton et al.
3,917,436 A * 11/1975 Dower ..... 417/5
3,964,556 A 6/1976 Gearhart et al.
4,078,620 A 3/1978 Westlake et al.
4,269,569 A * 5/1981 Hoover ..... 417/5
4,461,359 A 7/1984 Jones, Jr. et al.
4,471,843 A 9/1984 Jones, Jr. et al.
4,550,392 A 10/1985 Mumby (Continued)

FOREIGN PATENT DOCUMENTS

DE 196 27 719 1/1998

(Continued)

OTHER PUBLICATIONS

Odell II et al., "Application of a Highly Variable Gauge Stabilizer at Wytch Farm to Extend the ERD Envelope," *SPE 30462*, SPE Annual Technical Conference and Exhibition, pp. 119-129 (Oct. 22-25 1995).

(Continued)

*Primary Examiner*—Frank Tsay
(74) *Attorney, Agent, or Firm*—James L. Kurka; Kevin P. McEnaney; Dale V. Gaudier

(57) ABSTRACT

A downlink system that includes at least one mud pump for pumping drilling fluid from a drilling fluid storage tank to a drilling system, a standpipe in fluid communication with the mud pump and in fluid communication with the drilling system, and a return line in fluid communication with the drilling system for returning the drilling fluid to the drilling fluid storage tank is provided. A drilling fluid modulator may be in fluid communication with at least one of the group consisting of the standpipe and the return line.

5 Claims, 9 Drawing Sheets

U.S. PATENT DOCUMENTS 4,556,884 A 12/1985 Howells et al.
4,562,560 A 12/1985 Kamp
4,689,775 A 8/1987 Scherbatskoy
4,694,439 A 9/1987 Moll
4,715,022 A 12/1987 Yeo
4,733,232 A 3/1988 Grosso
4,774,694 A * 9/1988 Moll ..... 367/83
4,794,534 A 12/1988 Millheim
4,932,005 A 6/1990 Birdwell
4,953,595 A 9/1990 Kotlyar
5,034,929 A 7/1991 Cobern et al.
5,080,182 A 1/1992 Thompson
5,113,379 A 5/1992 Scherbatskoy et al.
5,115,415 A 5/1992 Mumby et al.
5,148,408 A 9/1992 Matthews
5,150,333 A 9/1992 Scherbatskoy
5,182,730 A 1/1993 Scherbatskoy
5,182,731 A 1/1993 Hoelscher et al.
5,253,271 A 10/1993 Montgomery
5,318,137 A 6/1994 Johnson et al.
5,318,138 A 6/1994 Dewey et al.
5,331,318 A 7/1994 Montgomery
5,332,048 A 7/1994 Underwood et al.
5,341,886 A 8/1994 Patton
5,390,153 A 2/1995 Scherbatskoy
5,467,083 A 11/1995 McDonald et al.
5,474,142 A 12/1995 Bowden
5,495,237 A 2/1996 Yuasa et al.
5,579,283 A 11/1996 Owens et al.
5,586,083 A 12/1996 Chin et al.
5,615,172 A 3/1997 Kotylar
5,703,836 A 12/1997 Drumheller
5,713,422 A 2/1998 Dhindsa
5,722,488 A 3/1998 Norman et al.
5,787,052 A 7/1998 Gardner et al.
5,802,011 A 9/1998 Winters et al.
5,818,352 A 10/1998 McClure
5,836,353 A 11/1998 Van Steenwyk
5,838,727 A 11/1998 Lyon et al.
5,846,056 A * 12/1998 Dhindsa et al. ..... 417/44.2
5,944,121 A 8/1999 Bischel et al.
5,955,966 A 9/1999 Jeffryes et al.
5,959,547 A 9/1999 Tubel et al.
5,963,138 A 10/1999 Gruenhagen
6,021,095 A 2/2000 Tubel et al.
6,029,951 A 2/2000 Guggari
6,097,310 A 8/2000 Harrell et al.
6,105,690 A 8/2000 Biglin, Jr. et al.
6,182,764 B1 2/2001 Vaynshteyn
6,209,662 B1 4/2001 Stahl
6,267,185 B1 7/2001 Mougel et al.
6,348,876 B1 2/2002 Wei et al.
6,513,606 B1 2/2003 Krueger
6,516,898 B1 2/2003 Krueger
6,536,529 B1 3/2003 Kerr et al.
6,550,538 B1 4/2003 Herrmann et al.
6,552,665 B1 4/2003 Miyamae et al.
6,626,253 B2 9/2003 Hahn et al.
6,763,883 B2 7/2004 Green et al.
6,920,085 B2 * 7/2005 Finke et al. ..... 367/83
6,970,398 B2 11/2005 Lavrut et al.
2002/0113718 A1 8/2002 Wei et al.
2002/0157871 A1 10/2002 Tulloch
2003/0016164 A1 1/2003 Finke et al.
2004/0012500 A1 1/2004 Hahn et al.

FOREIGN PATENT DOCUMENTS

EP 0 078 907 5/1983
EP 0 744 527 B1 5/1995
EP 0 697 498 2/1996
EP 0 617 196 A3 4/1996
EP 0 617 196 B1 6/2000
EP 0 744 527 7/2001
GB 2 344 910 6/2000
WO WO 99/19751 4/1999
WO WO 99/54591 10/1999
WO WO 99/61746 12/1999
WO WO 02/06630 1/2002
WO WO 02/29441 4/2002
WO WO 02/077413 10/2002

OTHER PUBLICATIONS

Baker Hughes/INTEQ advertising brochure The AutoTrak® System, Baker Hughes Incorporated (2001).

* cited by examiner

AUTOMATIC DOWNLINK SYSTEM

CROSS REFERENCE TO RELATED APPLICATIONS

This application is a divisional of U.S. patent application Ser. No. 10/605,248 filed on Sep. 17, 2003 and assigned to the assignee of the present invention.

BACKGROUND OF INVENTION

Wells are generally drilled into the ground to recover natural deposits of hydrocarbons and other desirable materials trapped in geological formations in the Earth's crust. A well is typically drilled using a drill bit attached to the lower end of a drill string. The well is drilled so that it penetrates the subsurface formations containing the trapped materials and the materials can be recovered.

At the bottom end of the drill string is a "bottom hole assembly" ("BHA"). The BHA includes the drill bit along with sensors, control mechanisms, and the required circuitry. A typical BHA includes sensors that measure various properties of the formation and of the fluid that is contained in the formation. A BHA may also include sensors that measure the BHA's orientation and position.

The drilling operations are controlled by an operator at the surface. The drill string is rotated at a desired rate by a rotary table, or top drive, at the surface, and the operator controls the weight-on-bit and other operating parameters of the drilling process.

Another aspect of drilling and well control relates to the drilling fluid, called "mud." The mud is a fluid that is pumped from the surface to the drill bit by way of the drill string. The mud serves to cool and lubricate the drill bit, and it carries the drill cuttings back to the surface. The density of the mud is carefully controlled to maintain the hydrostatic pressure in the borehole at desired levels.

In order for the operator to be aware of the measurements made by the sensors in the BHA, and for the operator to be able to control the direction of the drill bit, communication between the operator at the surface and the BHA are necessary. A "downlink" is a communication from the surface to the BHA. Based on the data collected by the sensors in the BHA, an operator may desire to send a command to the BHA. A common command is an instruction for the BHA to change the direction of drilling.

Likewise, an "uplink" is a communication from the BHA to the surface. An uplink is typically a transmission of the data collected by the sensors in the BHA. For example, it is often important for an operator to know the BHA orientation. Thus, the orientation data collected by sensors in the BHA is often transmitted to the surface. Uplink communications are also used to confirm that a downlink command was correctly understood.

One common method of communication is called "mud pulse telemetry." Mud pulse telemetry is a method of sending signals, either downlinks or uplinks, by creating pressure and/or flow rate pulses in the mud. These pulses may be detected by sensors at the receiving location. For example, in a downlink operation, a change in the pressure or the flow rate of the mud being pumped down the drill string may be detected by a sensor in the BHA. The pattern of the pulses, such as the frequency and the amplitude, may be detected by the sensors and interpreted so that the command may be understood by the BHA.

Mud pulse telemetry is well known in the drilling art. A common prior art technique for downlinking includes the temporary interruption of drilling operations so that the mud pumps at the surface can be cycled on and off to create the pulses. Drilling operations must be interrupted because the drill bit requires a continuous flow of mud to operate properly. Thus, drilling must be stopped while the mud pumps are being cycled.

FIG. 1A shows a prior art mud pulse telemetry system 100. The system 100 includes a mud pump 102 that pumps the mud from the surface, to the BHA 112, and back to the surface. A typical drilling rig will have multiple mud pumps that cooperate to pump the mud. Mud pumps are positive displacement pumps, which are able to pump at a constant flow rate at any pressure. These pumps are diagrammatically represented as one pump 102.

Mud from the mud storage tank 104 is pumped through the pump 102, into a standpipe 108, and down the drill string 110 to the drill bit 114 at the bottom of the BHA 112. The mud leaves the drill string 110 through ports (not shown) in the drill bit 114, where it cools and lubricates the drill bit 114. The mud also carries the drill cuttings back to the surface as it flows up through the annulus 116. Once at the surface, the mud flows through a mud return line 118 that returns the mud to the mud storage tank 104. A downlink operation involves cycling the pump 102 on and off to create pulses in the mud. Sensors in the BHA detect the pulses and interpret them as an instruction.

Another prior art downlink technique is shown in FIG. 1B. The downlink signal system 120 is a bypass from the standpipe 108 to the mud return line 118. The system 120 operates by allowing some of the mud to bypass the drilling system. Instead of passing through the drill string (110 in FIG. 1A), the BHA (112 in FIG. 1A), and returning through the annulus (116 in FIG. 1A), a relatively small fraction of the mud flowing through the standpipe 108 is allowed to flow directly into the mud return line 118. The mud flow rate to the BHA (not shown) is decreased by the amount that flows through the bypass system 120.

The bypass system 120 includes a choke valve 124. During normal operations, the choke valve 124 may be closed to prevent any flow through the bypass system 120. The full output of the mud pump 102 will flow to the BHA (not shown) during normal operations. When an operator desires to send an instruction to the BHA (not shown), a downlink signal may be generated by sequentially opening and closing the choke valve 124. The opening and closing of the choke valve 124 creates fluctuations in the mud flow rate to the BHA (not shown) by allowing a fraction of the mud to flow through the bypass 120. These pulses are detected and interpreted by the sensors in the BHA (not shown). The bypass system 120 may include flow restrictors 122, 126 to help regulate the flow rate through the system 120.

One advantage to this type of system is that a bypass system diverts only a fraction of the total flow rate of mud to the BHA. With mud still flowing to the BHA and the drill bit, drilling operations may continue, even while a downlink signal is being sent.

SUMMARY OF INVENTION

One aspect of the invention relates to a downlink system comprising at least one mud pump for pumping drilling fluid from a drilling fluid storage tank to a drilling system, a standpipe in fluid communication with the mud pump and in fluid communication with the drilling system, a return line in fluid communication with the drilling system for returning the drilling fluid to the drilling fluid storage tank, and a drilling fluid modulator in fluid communication with at least one of the group consisting of the standpipe and the return line.

Another aspect of the invention relates to a method of transmitting a downlink signal comprising pumping drilling fluid to a drilling system and selectively operating a modulator to create pulses in a drilling fluid flow. In some embodiments the modulator is disposed in a standpipe.

One aspect of the invention relates to a drilling fluid pump controller comprising at least one actuation device coupled to a control console, and at least one connector coupled to the at least one actuation device and a pump control mechanism. In at least one embodiment, the pump control mechanism is a pump control knob.

Another aspect of the invention relates to a method for generating a downlink signal comprising coupling an actuation device to a pump control panel, coupling the actuation device to a pump control device on the pump control panel, and creating a pulse in a drilling fluid flow by selectively controlling the pump control device with the actuation device.

Another aspect of the invention relates to a downlink system comprising a drilling fluid pump in fluid communication with a drilling system, the drilling fluid pump having a plurality of pumping elements, and a pump inefficiency controller operatively coupled to at least one of the plurality of pumping elements for selectively reducing the efficiency of the at least one of the plurality of pumping elements.

Another aspect of the invention relates to a method of generating a downlink signal comprising pumping drilling fluid using at least one drilling fluid pump having a plurality of pumping elements, and creating a pulse in a drilling fluid flow by selectively reducing the efficiency of at least one of the plurality of pumping elements.

Another aspect of the invention relates to a downlink system comprising at least one primary drilling fluid pump in fluid communication with a drilling fluid tank at an intake of the at least one drilling fluid pump and in fluid communication with a standpipe at a discharge of the at least one drilling fluid pump, and a downlink pump in fluid communication with the standpipe at a discharge of the reciprocating downlink pump.

Another aspect of the invention relates to a method of generating a downlink signal comprising pumping drilling fluid to a drilling system at a nominal flow rate, and selectively alternately increasing and decreasing the mud flow rate of the drilling fluid using a downlink pump having an intake that is in fluid communication with a standpipe and having a discharge that is in fluid communication with the standpipe.

Another aspect of the invention relates to a downlink system comprising at least one primary drilling fluid pump in fluid communication with a drilling fluid tank at an intake of the at least one drilling fluid pump and in fluid communication with a standpipe at a discharge of the at least one drilling fluid pump, and an electronic circuitry operatively coupled to the at least one primary drilling fluid pump and adapted to modulate a speed of the at least one primary drilling fluid pump.

Another aspect of the invention relates to a method of generating a downlink signal comprising operating at least one primary drilling fluid pump to pump drilling fluid through a drilling system, and engaging an electronic circuitry that is operatively coupled to the at least one primary drilling fluid pump to modulate a speed of the at least one primary drilling fluid pump.

Other aspects and advantages of the invention will be apparent from the following description and the appended claims.

DETAILED DESCRIPTION

In certain embodiments, the present invention relates to downlink systems and methods for sending a downlink signal. A downlink signal may be generated by creating pulses in the pressure or flow rate of the mud being pumped to the drill bit. The invention will be described with reference to the attached figures.

The following terms have a specialized meaning in this disclosure. While many are consistent with the meanings that would be attributed to them by a person having ordinary skill in the art, the meanings are also specified here.

In this disclosure, "fluid communication" is intended to mean connected in such a way that a fluid in one of the components may travel to the other. For example, a bypass line may be in fluid communication with a standpipe by connecting the bypass line directly to the standpipe. "Fluid communication" may also include situations where there is another component disposed between the components that are in fluid communication. For example, a valve, a hose, or some other piece of equipment used in the production of oil and gas may be disposed between the standpipe and the bypass line. The standpipe and the bypass line may still be in fluid communication so long as fluid may pass from one, through the interposing component or components, to the other.

"Standpipe" is a term that is known in the art, and it typically refers to the high-pressure fluid passageway that extends about one-third of the way up a drilling rig. In this disclosure, however, "standpipe" is used more generally to mean the fluid passageway between the mud pump and the drill string, which may include pipes, tubes, hoses, and other fluid passageways.

A "drilling system" typically includes a drill string, a BHA with sensors, and a drill bit located at the bottom of the BHA. Mud that flows to the drilling system must return through the annulus between the drill string and the borehole wall. In the art, a "drilling system" may be known to include the rig, the rotary table, and other drilling equipment, but in this disclosure it is intended to refer to those components that come into contact with the drilling fluid.

In this disclosure, "selectively" is intended to indicate at a time that is selected by a person or by a control circuitry based on some criteria. For example, a drilling operator may select the time when a downlink signal is transmitted. In automated operations, a computer or control circuitry may select when to transmit a downlink signal based on inputs to the system.

Figure 2:
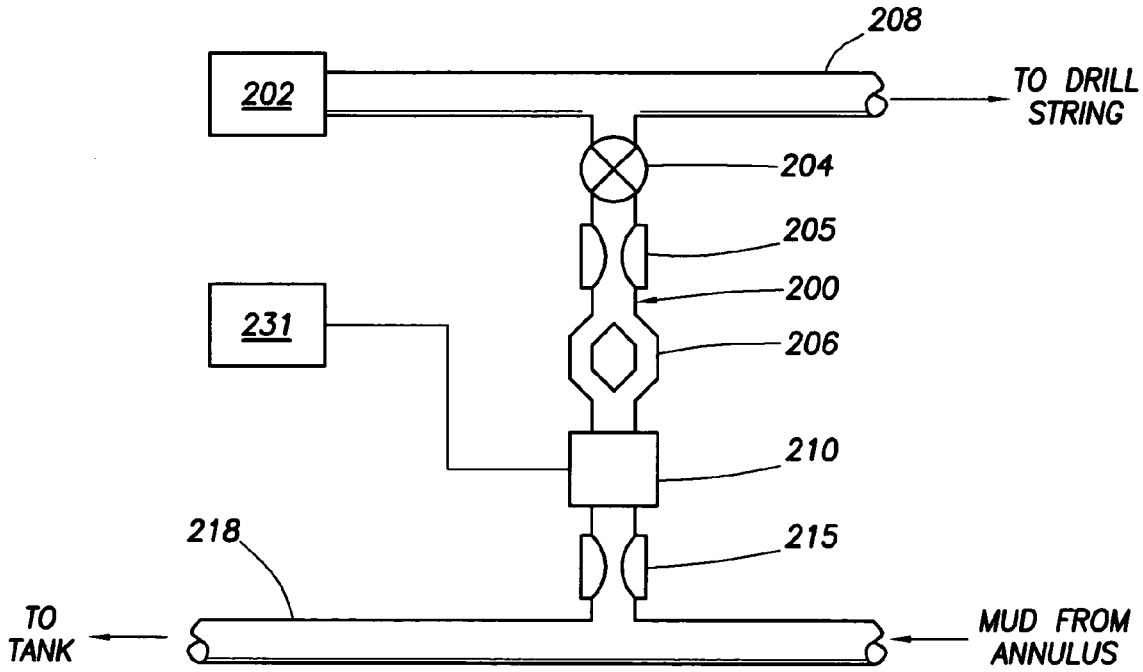
FIG. 2 shows a schematic of a bypass downlink system in accordance with one embodiment of the invention.

FIG. 2 shows a schematic of a downlink system in accordance with one embodiment of the invention. The system includes a bypass line 200 with a shutoff valve 204, a flow restrictor 205, a flow diverter 206, a modulator 210 coupled to a control circuitry 231, and a second flow restrictor 215. The bypass 200 is in fluid communication with the standpipe 208 at an upstream end and with the mud return line 218 on a downstream end. This arrangement enables the bypass line 200 to divert mud flow from the standpipe 208, thereby reducing the flow rate to the BHA (not shown).

The bypass system 200 includes a modulator 210 for varying the flow rate of mud through the bypass system 200. The frequency and amplitude of the flow rate changes define the downlink signal. One embodiment of a modulator will be described in more detail later, with respect to FIG. 3A.

Figure 1A:
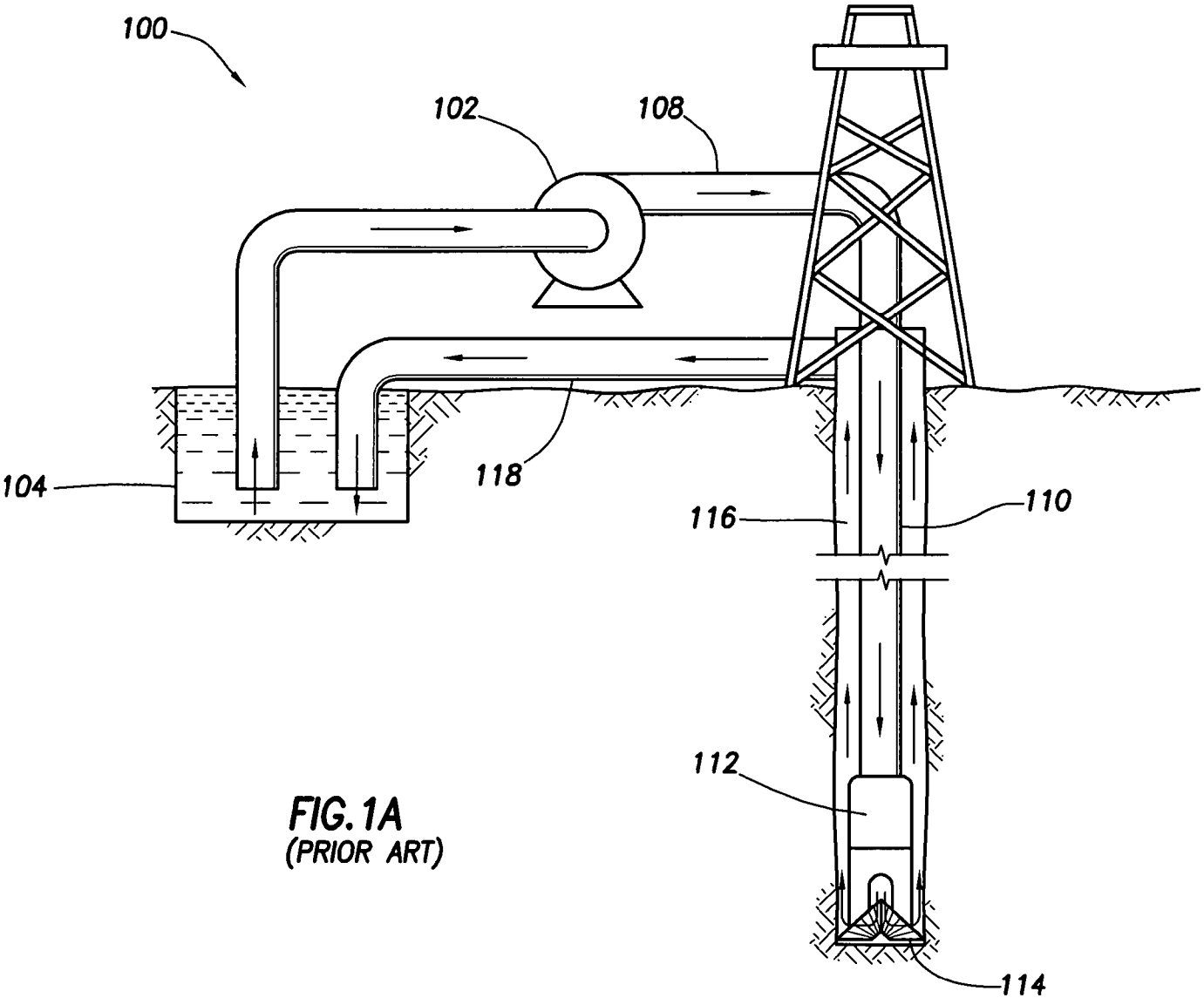
FIG. 1A (PRIOR ART)
FIG. 1A shows a schematic of a prior art downlink system.
Figure 1B:
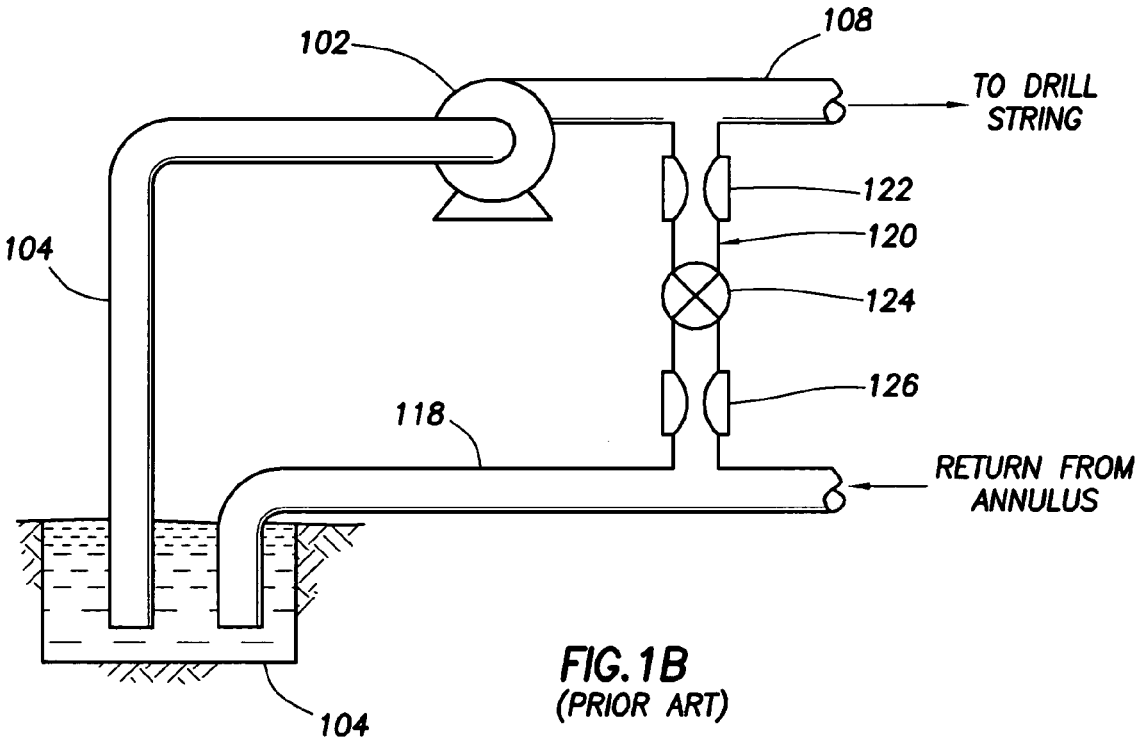
FIG.1B (PRIOR ART)
FIG. 1B shows a schematic of a prior art bypass downlink system.

The downlink system in FIG. 2 includes a shutoff valve 204. The shutoff valve 204 is .0.0used to isolate the bypass line 200 when no downlink signal is being transmitted. By closing the shutoff valve 204, the downlink system is protected from erosion that can occur when mud flows through the components of the system. When the bypass line 200 is in use, the shutoff valve 204 may be in a fully open position so that it will not be exposed to the high mud velocities that erode the choke valves (e.g., 124 in FIG. 1B) of the prior art. In a preferred embodiment, the shutoff valve 204 is disposed up stream of a flow restrictor (e.g., 205) so that the shutoff valve 204 will not experience the high mud flow rates present downstream of a flow restrictor.

Flow diverters and flow restrictors are components that are well known in the art. They are shown diagrammatically in several of the Figures, including FIG. 2. Those having skill in the art will be familiar with these components and how they operate. The following describes their specific operation in those embodiments of the invention that include either a flow restrictor or a flow diverter.

In some embodiments, a bypass line 200 according to the invention includes a flow restrictor 205. The flow restrictor 205 provides a resistance to flow that restricts the amount of mud that may flow through the bypass line 200. The flow restrictor 205 is also relatively low cost and easily replaced. This enables the flow restrictor 205 to be eroded by the mud flow without damaging more expensive parts of the system.

When the flow restrictor 205 is located upstream from the modulator 210, it may also serve as a pressure pulse reflector that reduces the amount of noise generated in the standpipe 208. For example, the modulator 210 may be used to create pulses in the mud flow. This has a side effect of creating back pulses of pressure that will propagate through the standpipe 208 and create noise. In drilling systems that also use uplink telemetry, noise may interfere with the detection of the uplink signal. A flow restrictor 205 will reflect a large portion of these back pressure pulses so that the standpipe 208 will be much less affected by noise.

It is noted that in the cases where the downlink sensors on the BHA are pressure transducers, it may be desirable to use a downlink system without a flow restrictor upstream of the modulator. Thus, some embodiments of a downlink system in accordance with the invention do not include a flow restrictor 205. Those having ordinary skill in the art will be able to devise a downlink system with selected components to fit the particular application.

In some embodiments, a downlink system in accordance with the invention includes a flow diverter 206 that is located upstream from the modulator 210. A flow diverter 206 may be used to reduce the amount of turbulence in the bypass line 202. The flow diverter 206 is shown as a double branch flow diverter, but other types of flow diverters may be used. For example, a flow diverter with several bends may also be used. Those having ordinary skill in the art will be able to devise other flow diverters without departing from the scope of the invention.

A flow diverter 206 may be advantageous because the mud flow downstream of a flow restriction 205 is often a turbulent flow. A flow diverter 206 may be used to bring the mud flow back to a less turbulent flow regime. This will reduce the erosion effect that the mud flow will have on the modulator 210.

In some embodiments, the flow diverter 206 is coated with an erosion resistant coating. For example, a material such as carbide or a diamond coating could prevent the erosion of the inside of the flow diverter 206. In at least one embodiment, the flow diverter 206 includes carbide inserts that can be easily replaced. In this regard, the insert may be thought of as a sacrificial element designed to wear out and be replaced.

In some embodiments, a downlink system 200 in accordance with the invention includes a second flow restrictor 215 that is disposed downstream of the modulator 210. The second flow restrictor serves to generate enough back pressure to avoid cavitation in the modulator 210. Cavitation is a danger because it affects the mud pulse signal and it causes severe erosion in the modulator 210. In situations where cavitation is not a danger, it may be advantageous to use embodiments of the invention that do not include a second or downstream flow restrictor 215.

Those having skill in the art will realize that the above described components may be arranged in a downlink system in any order that may be advantageous for the particular application. For example, the embodiment shown in FIG. 2 may be modified by adding a second flow diverter downstream of the second flow restrictor 215. Those having ordinary skill in the art will be able to devise other component arrangements that do not depart from the scope of the invention.

Figure 3A:
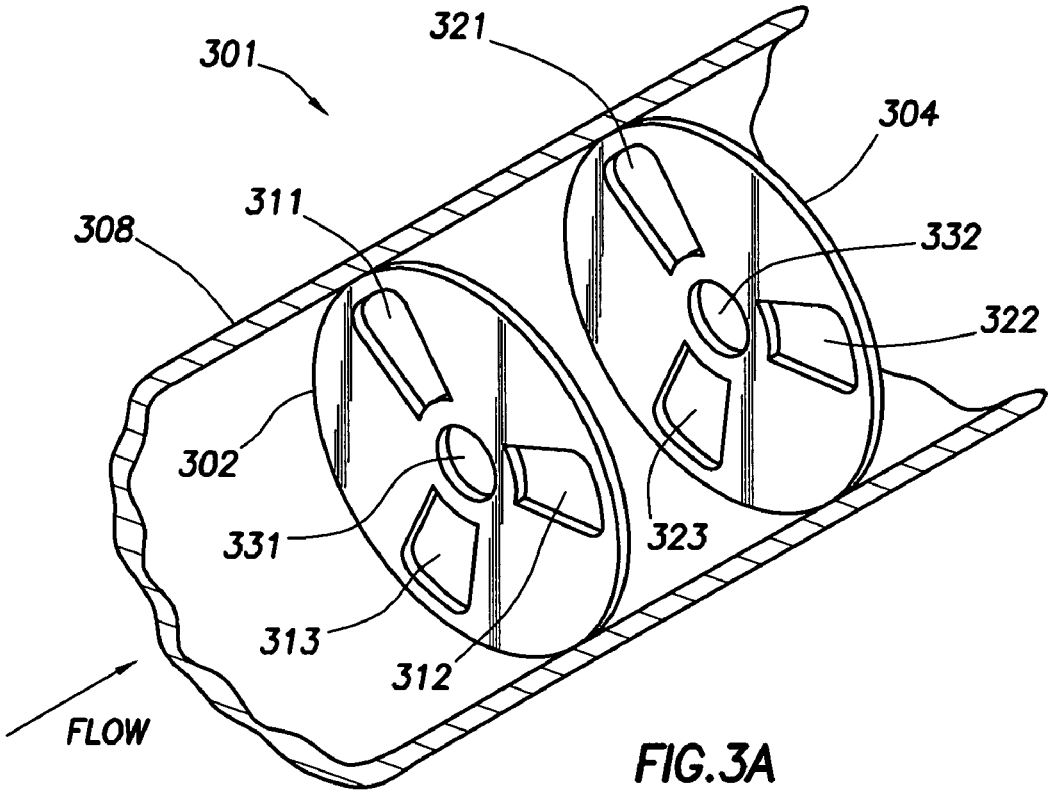
FIG. 3A shows an exploded view of a modulator in accordance with one embodiment of the invention.

FIG. 3A shows an exploded view of a modulator 301 in accordance with the invention. The modulator 301 is positioned inside a pipe section 308, such as a bypass line or a standpipe. As shown in FIG. 3A, the modulator 301 includes a rotor 302 and a stator 304 (or restrictor). Preferably, the rotor includes three passages 311, 312, 313 that allow fluid to pass through the rotor 302. The stator includes similar passages 321, 322, 323.

The view in FIG. 3A is exploded. Typically, the rotor 302 and the stator 304 would be connected so that there is no gap or a small gap between them. A typical modulator may also include a motor (not shown in FIG. 3A) to rotate the rotor 302.

As the rotor 302 rotates, the passages 311, 312, 313 in the rotor 302 alternately cover and uncover the passages 321, 322, 323 in the stator 304. When the passages 321, 322, 323 in the stator are covered, flow through the modulator 301 is restricted. The continuous rotation of the rotor 302 causes the flow restriction in the modulator 301 to alternately close to a minimum size and open to a maximum size. This creates sine wave pulses in the mud flow.

In some embodiments, such as the one shown in FIG. 3A, the rotor 302 includes a central passage 331 that enables fluid to pass through the rotor 302. The stator 304 has a similar central passage 332. The central passages 331, 332 enable at least some flow to pass through the modulator so that the flow through the modulator 301 is never completely stopped.

In some embodiments, the passages 311, 312, 313 in the rotor 302 are sized so that they never completely block the passages 321, 322, 323 in the stator 304. Those having skill in the art will be able to devise other embodiments of a rotor and a stator that do not depart from the scope of the invention.

Figure 3B:
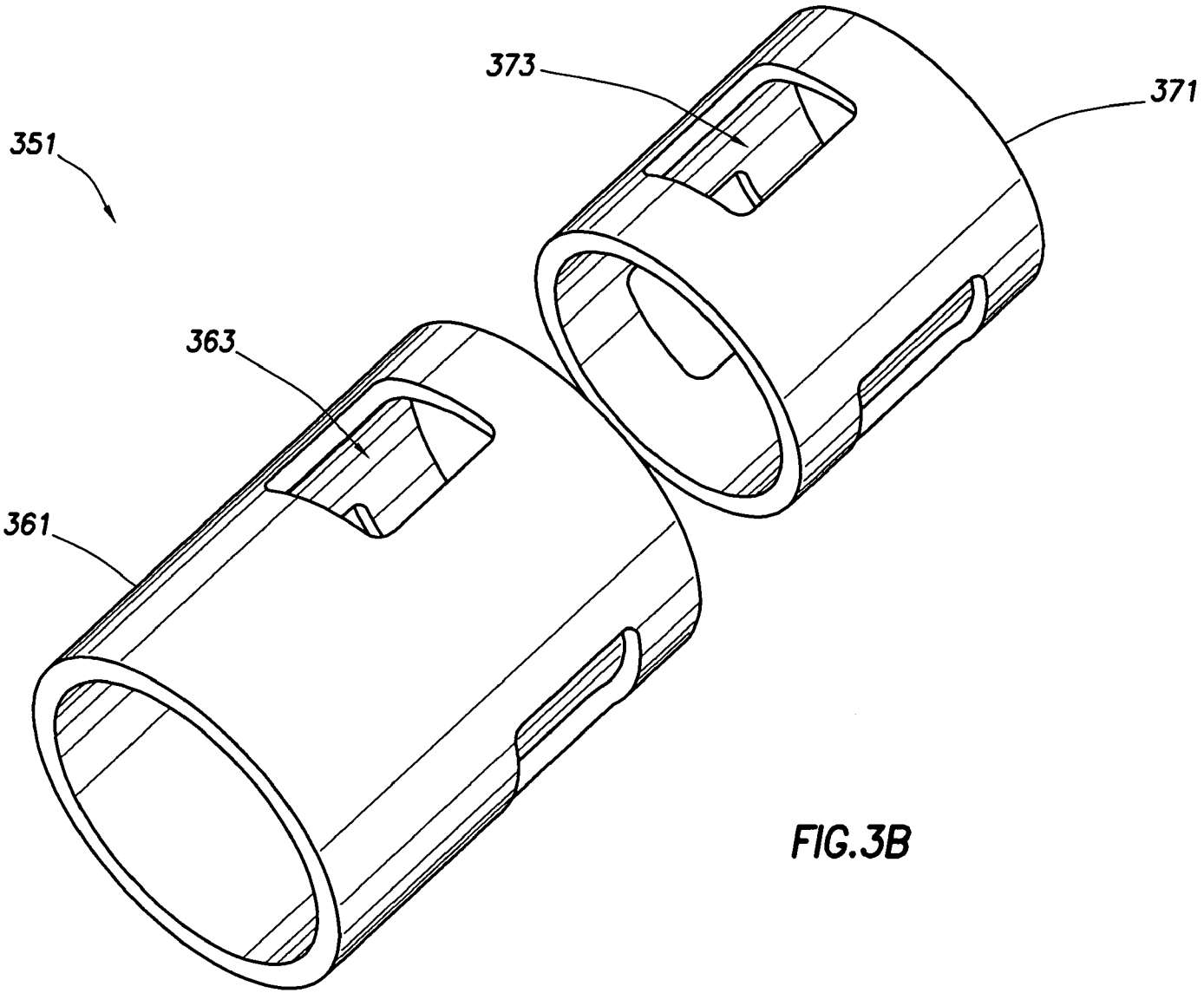
FIG. 3B shows an exploded view of a modulator in accordance with one embodiment of the invention.

FIG. 3B shows an exploded view of another embodiment of a modulator 351 in accordance with the invention. The modulator 351 includes two sections 361 and 371 that may be arranged to modulate the flow. For example, in one embodiment, section 371 comprises an inner segment that fits into the outer section 361. The modulator may then be installed in a pipe (not shown).

Flow through the pipe may be modulated by rotating one of the sections with respect to the other. For example, the inner section 371 may be rotated with respect to the outer section 361. As the windows 373 in the inner section align with the windows 363 in the outer section 361, the flow though the modulator 351 is maximized. When the windows 373 in the inner section 371 are not aligned with the windows 363 in the outer section 361, the flow through the modulator is minimized.

The modulator 351 may be arranged in different configurations. For example, the modulator 351 may be arranged parallel to the flow in a pipe. In such a configuration, the modulator 351 may be able to completely block flow through the pipe when the windows 363, 373 are not aligned. In some embodiments, the modulator is arranged so that fluid may pass the modulator in the annulus between the modulator 351 and the pipe (not shown). In those embodiments, the flow through the center of the modulator may be modulated by rotating one of the sections 361, 371 with respect to the other. In other embodiments, the modulator may be arranged to completely block the flow through the pipe when the windows 363, 373 are not aligned.

In some other embodiments, the modulator may be arranged perpendicular to the flow in a pipe (not shown). In such an embodiment, the modulator may act as a valve that modulates the flow rate through the pipe. Those having skill in the art will be able to devise other embodiments and arrangements for a modulator without departing from the scope of the invention.

One or more embodiments of a downlink system with a modulator may present some of the following advantages. A modulator may generate sine waves with a frequency and amplitude that are easily detectable by sensors in a BHA. The frequency of the sine waves may also enable a much faster transmission rate than was possible with prior art systems. Advantageously, a sine wave has less harmonics and generates less noise that other types of signals. Certain embodiments of the invention may enable the transmission of a downlink signal in only a few minutes, compared to the twenty to thirty minutes required in some prior art systems.

Advantageously, certain embodiments of the invention enable a downlink signal to be transmitted simultaneous with drilling operations. This means that a downlink signal may be transmitted while drilling operations continue and without the need to interrupt the drilling process. Some embodiments enable the adjustment of the modulator so that an operator can balance the need for signal strength with the need for mud flow. Moreover, in situations where it becomes necessary to interrupt drilling operations, the improved rate of transmission will enable drilling to continue in a much shorter time.

Figure 4A:
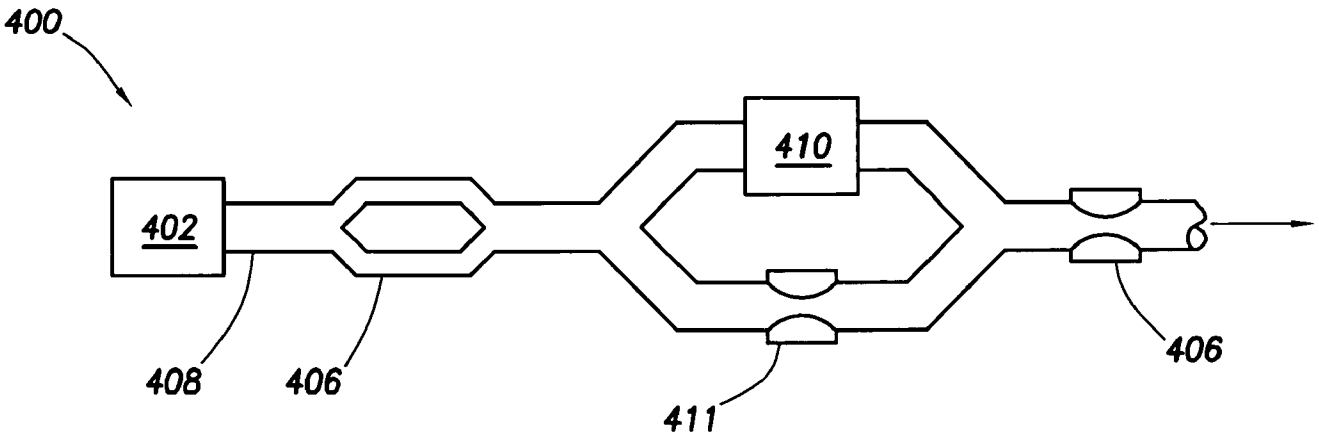
FIG. 4A shows a schematic of a bypass downlink system in accordance with one embodiment of the invention.

FIG. 4A shows another embodiment of a downlink system 400 in accordance with the invention. A modulator 410 is disposed in-line with the standpipe 408 and down stream of the mud pump 402. Instead of regulating the flow of mud through a bypass, the modulator 410 in the embodiment shown in FIG. 4A regulates the pressure in the standpipe 408.

In the embodiment shown in FIG. 4A, the downlink system 400 includes a flow diverter 406 downstream of the mud pump 402 and upstream of the modulator 410. The mud flow from the mud pump is often turbulent, and it may be desirable to create a normal flow regime upstream of the modulator 410. As was described above with reference to FIG. 3A, the flow diverter 406 may be coated on its inside with an erosion resistant coating, such as carbide or diamonds. In some embodiments, the flow diverter 406 may include a carbide insert designed to be easily replaced.

The modulator 410 shown in FIG. 4A is in parallel with a second flow restrictor 411. The second flow restrictor 411 enables some of the mud to flow past the modulator without being modulated. This has the effect of dampening the signal generated by the modulator 410. While this dampening will decrease the signal strength, it may nevertheless be desirable. The second flow restrictor 411 may enable enough mud to flow through the downlink system 400 so that drilling operations can continue when a downlink signal is being transmitted. Those having skill in the art will be able to balance the need for mud flow with the need for signal strength, when selecting the components of a downlink system.

In some embodiments, although not illustrated in FIG. 4A, a downlink system includes a flow restrictor downstream of the modulator 410. In many circumstances, the drilling system provides enough resistance that a flow restrictor is not required. When it is beneficial, however, one may be included to provide back pressure for proper operation of the modulator 410.

Figure 4B:
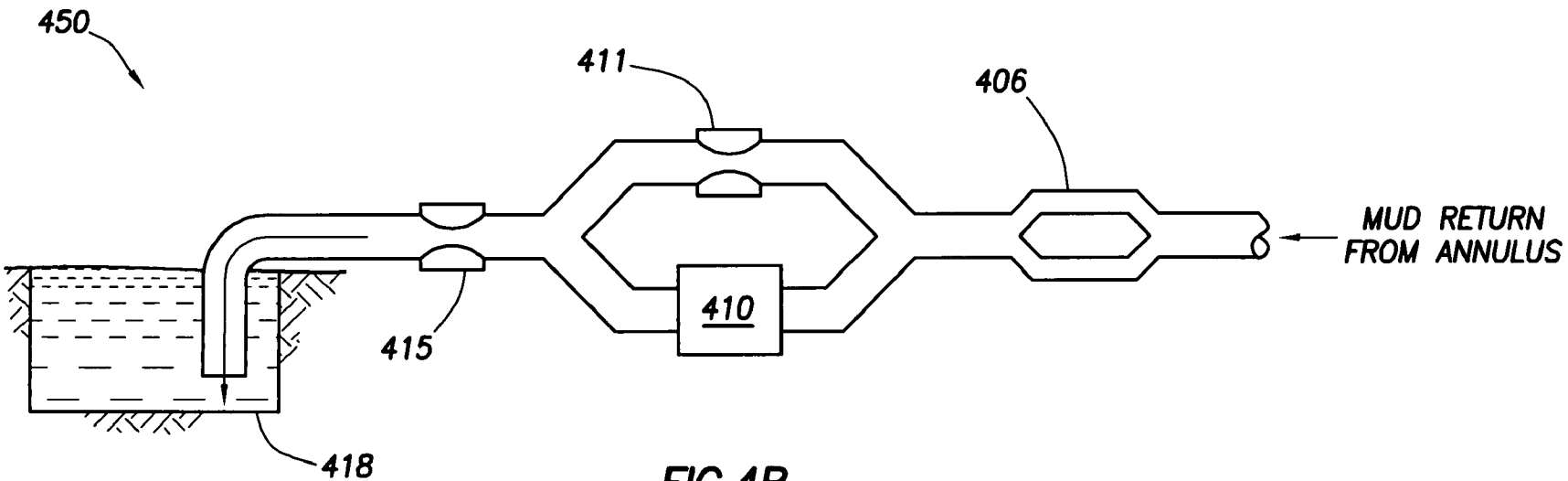
FIG. 4B shows a schematic of a bypass downlink system in accordance with another embodiment of the invention.

In another embodiment, shown in FIG. 4B, a downlink system 450 may be disposed in the mud return line 418. The embodiment shown in FIG. 4B includes a flow diverter 406, a modulator 410 in parallel with a flow restrictor 411, and a down stream flow restrictor 415. Each operates substantially the same as the same components described with reference to FIG. 4A. In this case, however, the downlink system 450 is located in the return line 418 instead of the standpipe (408 in FIG. 4A). The downlink system 450 is still able to modulate the mud pressure in the drilling system (not shown) so that the pulses may be detected by sensors in the BHA. Advantageously, a downlink system disposed in the mud return line generates a very small amount of noise in the standpipe that would affect uplink transmissions.

Figure 5A:
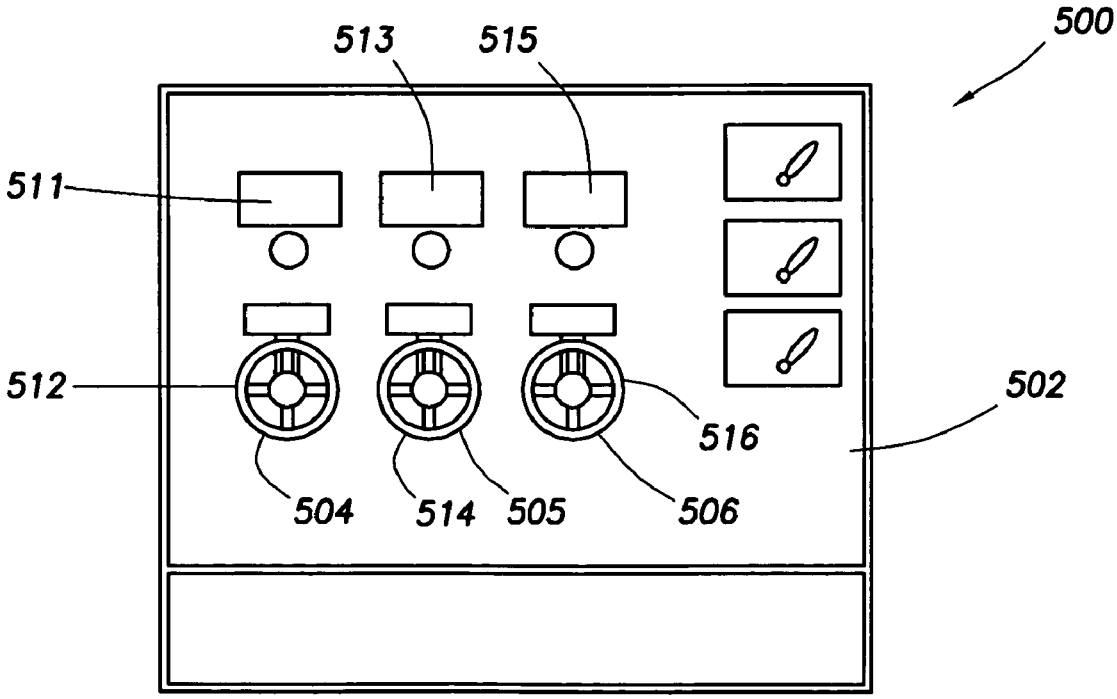
FIG. 5A shows a diagram of a downlink system in accordance with one embodiment of the invention.

One embodiment of a downlink control system 500 in accordance with the invention is shown in FIG. 5A. An operator's control console 502 typically includes pump control mechanisms. As shown in FIG. 5A the pump control mechanisms may comprise knobs 504, 505, 506 that control the speed of the mud pumps (not shown). FIG. 5A shows three control knobs 504, 505, 506 that may control three mud pumps (not shown). A drilling system may contain more or less than three mud pumps. Accordingly, the control console can have more or less mud pump control knobs. The number of control knobs on the control console is not intended to limit the invention.

A typical prior art method of sending a downlink system involves interrupting drilling operations and manually operating the control knobs 504, 505, 506 to cause the mud pumps to cycle on and off. Alternatively, the control knobs 504, 505, 506 may be operated to modulate the pumping rate so that a downlink signal may be sent while drilling continues. In both of these situations, a human driller operates the control knobs 504, 505, 506. It is noted that, in the art, the term "driller" often refers to a particular person on a drilling rig. As used herein, the term "driller" is used to refer to any person on the drilling rig.

In one embodiment of the invention, the control console 502 includes actuation devices 511, 513, 515 that are coupled the control knobs 504, 505, 506. The actuation devices 511, 513, 515 are coupled to the control knobs 504, 505, 506 by belts 512, 514, 516. For example, actuation device 511 is coupled to control knob 504 by a belt 512 that wraps around the stem of the control knob 504. The other actuation devices 511, 513 may be similarly coupled to control knobs 504, 505.

The actuation devices may operate in a number of different ways. For example, each actuation device may be individually set to operate a control knob to a desired frequency and amplitude. In some embodiments, the actuation devices 511, 513, 515 are coupled to a computer or other electronic control system that controls the operation of the actuation devices 511, 513, 515.

In some embodiments, the actuation devices 511, 513, 515 are integral to the control console 502. In some other embodiments, the actuation devices 511, 513, 515 may be attached to the control console 502 to operate the control knobs 504, 505, 506. For example, the actuation devices 511, 513, 515 may be magnetically coupled to the console 502. Other methods of coupling an actuation device to a console include screws and a latch mechanism. Those having skill in the art will be able to devise other methods for attaching an actuation device to a console that do not depart from the scope of the invention.

Figure 5B:
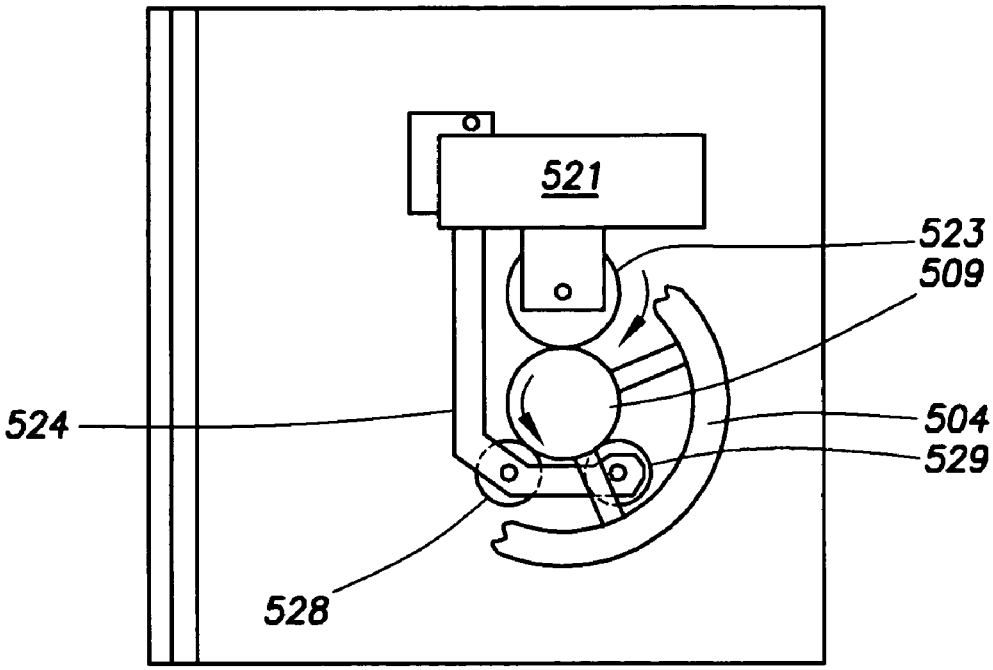
FIG. 5B shows a diagram of a downlink system in accordance with one embodiment of the invention.

The actuation devices 511, 513, 515 may be coupled to the control knobs 504, 505, 506 by methods other than belts 511, 513, 515. For example, FIG. 5B shows a pump control knob 504 that is coupled to an actuation device 521 using a drive wheel 523. The actuation device causes the drive wheel 523 to rotate, which, in turn, causes the stem 509 of the control knob 504 to rotate. In some embodiments, such as the one shown in FIG. 5B, an actuation device 521 includes a tension arm 524 to hold the actuation device 521 and the drive wheel 523 in place. The tension arm 524 in FIG. 5B includes two free rotating wheels 528, 529 that contact an opposite side of the stem 509 of the control knob 504 from the drive wheel 523.

Figure 5C:
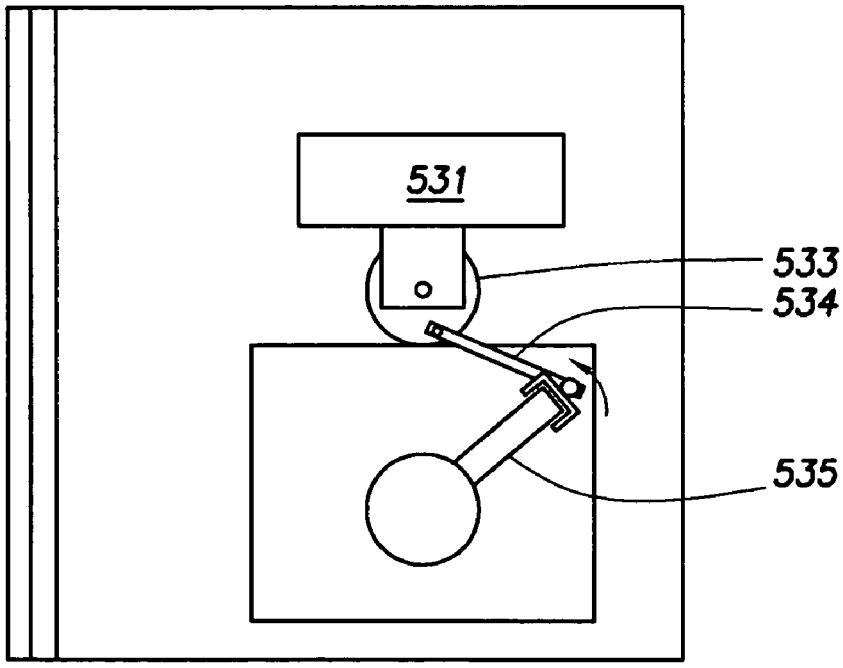
FIG. 5C shows a diagram of a downlink system in accordance with one embodiment of the invention.

FIG. 5C shows another embodiment of an actuation device 531 coupled to a pump control lever 535. The actuation device 531 includes a drive wheel 533 that is coupled to the pump control lever 535 by a connecting rod 534. When the drive wheel 533 is rotated by the actuation mechanism 531, the lever 535 is moved in a corresponding direction by the connecting rod 534.

Figure 5D:
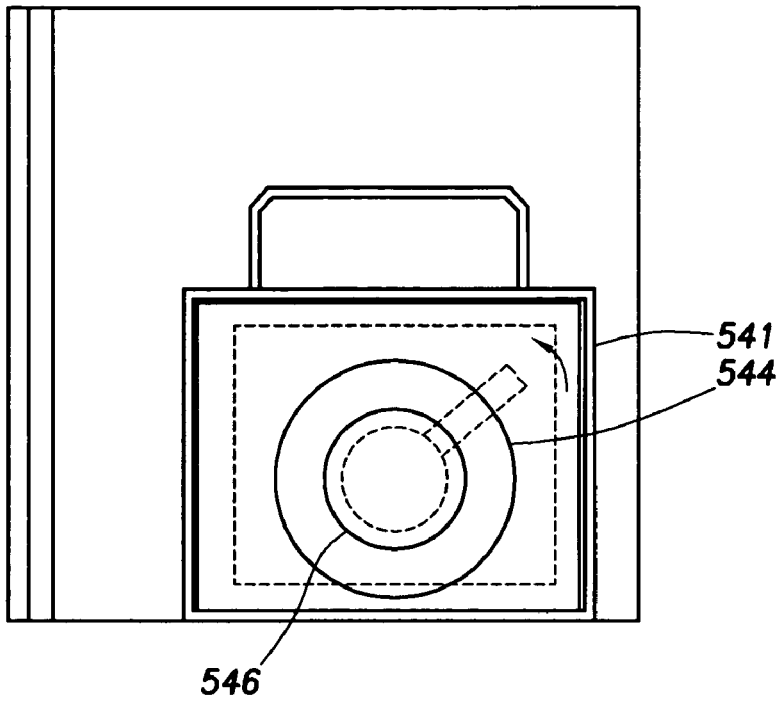
FIG. 5D shows a diagram of a downlink system in accordance with one embodiment of the invention.

FIG. 5D shows another embodiment of an actuation device 541 in accordance with the invention. The actuation device 541 mounts on top of the pump control lever 546. The actuation device 541 includes an internal shape that conforms to the shape of the pump control lever 546. As the internal drive 544 of the actuation device 541 rotates, the pump control lever 546 is also rotated.

One or more embodiments of an actuation device may present some of the following advantages. Actuation devices may be coupled to already existing drilling systems. Thus, an improved downlink system may be achieved without adding expensive equipment to the pumping system.

Advantageously, the mechanical control of an actuation device may be quicker and more precise than human control. As a result, a downlink signal may be transmitted more quickly and with a higher probability that the transmission will be correctly received on the first attempt. The precision of a mechanical actuation device may also enable sufficient mud flow and a downlink signal to be transmitted during drilling operation.

Advantageously, the mechanical control of an actuation device provides a downlink system where no additional components are needed that could erode due to mud flow. Because no other modifications are needed to the drilling system, operators and drillers may be more accepting of a downlink system. Further, such a system could be easily removed if it became necessary.

In some other embodiments, a downlink system comprises a device that causes the mud pumps to operate inefficiently or that causes at least a portion of the mud pumps to temporarily stop operating. For example, FIG. 6 diagrammatically shows a pump inefficiency controller 601 attached to a mud pump 602*a*. FIG. 6 shows three mud pumps 602*a*, 602*b*, 602*c*. Drilling rigs can include more or fewer than three mud pumps. Three are shown in FIG. 6A for illustrative purposes.

Each of the mud pumps 602*a*, 602*b*, 602*c* draws mud from the mud storage tank 601 and pumps the mud into the standpipe 608. Ideally, the mud pumps 602*a*, 602*b*, 602*c* will pump at a constant flow rate. The pump inefficiency controller 604 is connected to the first mud pump 602*a* so that the controller 604 may affect the efficiency of the first mud pump 602*a*.

Figure 6A:
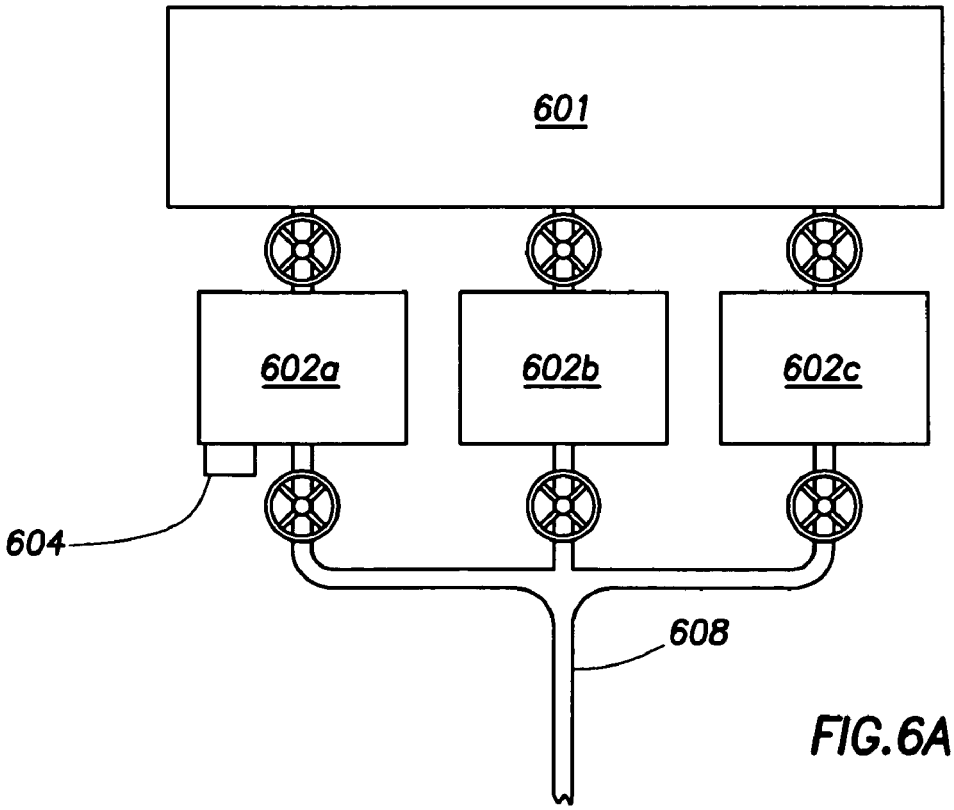
FIG. 6A shows a schematic of a downlink system in accordance with one embodiment of the invention.
Figure 6B:
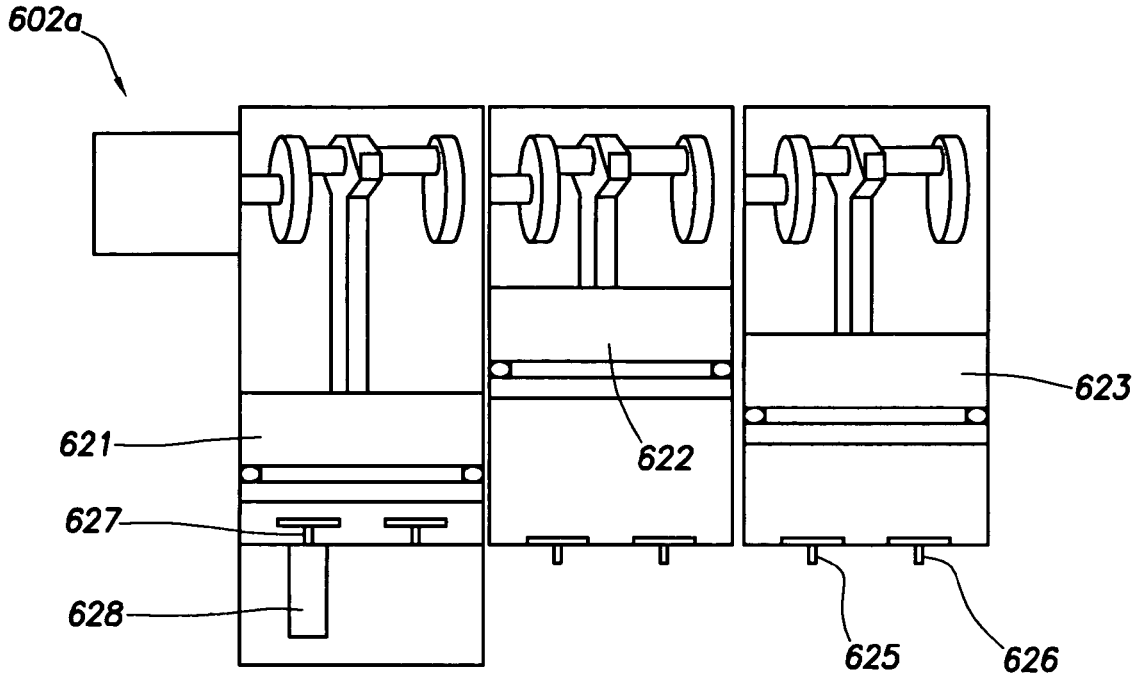
FIG. 6B shows a schematic of a mud pump in accordance with one embodiment of the invention.

FIG. 6B diagrammatically shows the internal pumping elements of the first mud pump 602*a*. The pumping elements of pump 602*a* include three pistons 621, 622, 623 that are used to pump the mud. For example, the third piston 623 has an intake stroke, where the piston 623 moves away from the intake valve 625, and mud is drawn from the mud tank into the piston chamber. The third piston 623 also has an exhaust stroke, where the piston 623 moves in the opposite direction and pushes the mud out an exhaust valve 626 and into the standpipe (608 in FIG. 6A). Each of the other pistons 621, 622 has a similar operation that will not be separately described.

The first piston 621 includes a valve controller 628 that forms part of, or is operatively coupled to, the pump inefficiency controller (604 in FIG. 6A). When it is desired to send a downlink signal, the valve controller 628 prevents the intake valve 627 on the first piston 621 from opening during the intake stroke. As a result, the first piston 621 will not draw in any mud that could be pumped out during the exhaust stroke. By preventing the intake valve 627 from opening, the efficiency of the first pump 603 is reduced by about 33%. The efficiency of the entire pumping system (including all three mud pumps 602*a*, 602*b*, 602*c* in the embodiment shown in FIG. 6A, for example) is reduced by about 11%.

By operating the pump inefficiency controller (604 in FIG. 6A), the efficiency, and thus the flow rate, of the mud pumping system can be reduced. Intermittent or selective operation of the pump efficiency controller creates pulses in the mud flow rate that may be detected by sensors in the BHA.

One or more embodiments of a pump inefficiency controller may present some of the following advantages. An inefficiency controller may be coupled to an preexisting mud pump system. The downlink system may operate without the need to add any equipment to the pump system. The pump inefficiency controlled may be controlled by a computer or other automated process so that human error in the pulse generation is eliminated. Without human error, the downlink signal may be transmitted more quickly with a greater chance of the signal being received correctly on the first attempt.

FIG. 7A diagrammatically shows another embodiment of a downlink system 700 in accordance with the invention. A downlink pump 711 is connected to the mud manifold 707 that leads to the standpipe 708, but it is not connected to the mud tanks 704. As with a typical mud pump system, several mud pumps 702*a*, 702*b*, 702*c* are connected to the mud tank 704. Mud from the tank is pumped into the mud manifold 707 and then into the standpipe 708.

As is known in the art, pumps have an "intake" where fluid enters the pumps. Pumps also have a "discharge," where fluid is pumped out of the pump. In FIG. 7A, the intake end of each of the mud pumps 702*a*, 702*b*, 702*c* is connected to the mud storage tank 704, and the discharge end of each of the mud pumps 702*a*, 702*b*, 702*c* is connected to the mud manifold 707. Both the intake and the discharge of the downlink pump 711 are connected to the mud manifold 707.

The downlink pump 711 shown in FIG. 7A is a reciprocating piston pump that has intake and exhaust strokes like that described above with respect to FIG. 6B. On the intake stroke, mud is drawn into the downlink pump 711, and on the exhaust stroke, mud is forced out of the downlink pump 711. The operation of the downlink pump 711 differs from that of the other pumps 702*a*, 702*b*, 702*c* in the mud pump system because it is not connected to the mud tank 704. Instead, both the intake and exhaust valves (not shown) of the downlink pump 711 are connected to the mud manifold 707. Thus, on the intake stroke, the downlink pump 711 draws in mud from the mud manifold 707, decreasing the overall flow rate from the mud pump system. On the exhaust stroke, the downlink pump 711 pumps mud into the mud manifold 707 and increases the overall flow rate from the mud pump system. In some embodiments, one valve serves as both the inlet and the discharge for the downlink pump. In at least one embodiment, a downlink pump is connected to the manifold, but it does not include any valves. The mud is allowed to flow in and out of the downlink pump through the connection to the manifold.

Selected operation of the downlink pump 711 will create a modulation of the mud flow rate to the BHA (not shown). The modulation will not only include a decrease in the flow rate—as with the bypass systems described above—but it will also include an increase in the flow rate that is created on the exhaust stroke of the downlink pump 711. The frequency of the downlink signal may be controlled by varying the speed of the downlink pump 711. The amplitude of the downlink signal may be controlled by changing the stroke length or piston and sleeve diameter of the downlink pump 711.

Those having ordinary skill in the art will also appreciate that the location of a downlink pump is not restricted to the mud manifold. A downlink pump could be located in other locations, such as, for example, at any position along the standpipe.

Figure 8:
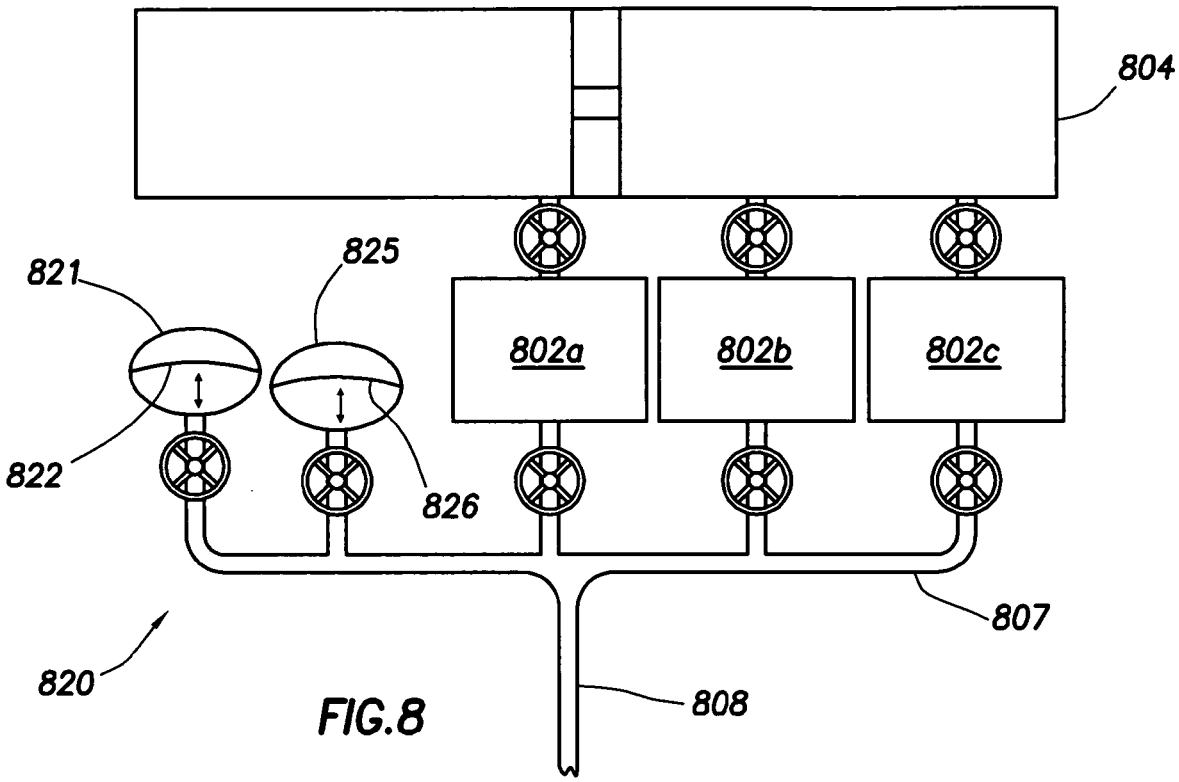
FIG. 8 shows a schematic of a downlink system in accordance with one embodiment of the invention.

FIG. 8 diagrammatically shows another embodiment of a downlink system 820 in accordance with the invention. The mud pumping system includes mud pumps 802*a*, 802*b*, 802*c* that are connected between a mud tank 804 and a standpipe 808. The operation of these components has been described above and, for the sake of brevity, it will not be repeated here.

The downlink system includes two diaphragm pumps 821, 825 whose intakes and discharges are connected to the mud manifold 807. The diaphragm pumps 821, 825 include diaphragms 822, 826 that separate the pumps 821, 825 into two sections. The position of the diaphragm 822 may be pneumatically controlled with air pressure on the back side of the diaphragm 822. In some embodiments, the position of the diaphragm 822 may be controlled with a hydraulic actuator mechanically linked to diaphragm 822 or with an electromechanical actuator mechanically linked to diaphragm 822. When the air pressure is allowed to drop below the pressure in the mud manifold 807, mud will flow from the manifold 807 into the diaphragm pump 821. Conversely, when the pressure behind the diaphragm 822 is increased above the pressure in the mud manifold 807, the diaphragm pump 821 will pump mud into the mud manifold 807.

Figure 7:
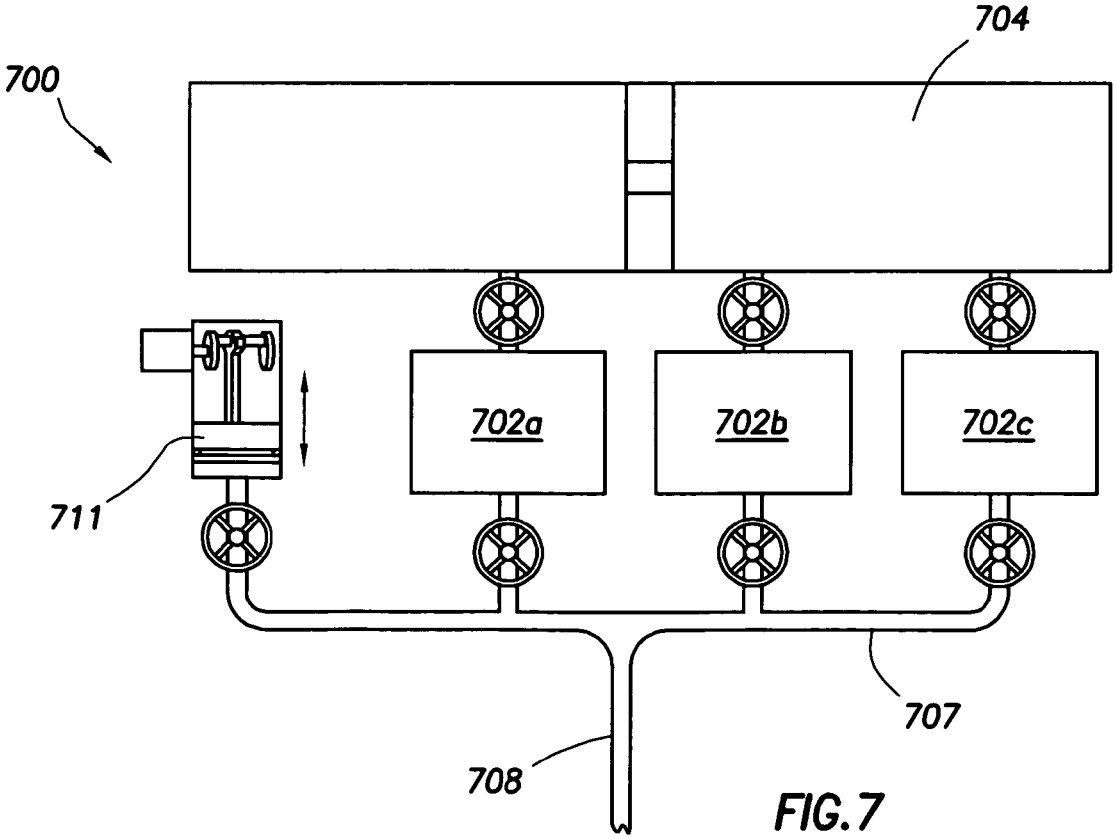
FIG. 7 shows a schematic of a downlink system in accordance with one embodiment of the invention.

FIG. 7 shows one piston downlink pump, and FIG. 8 shows two diaphragm downlink pumps. The invention is not intended to be limited to either of these types of pumps, nor is the invention intended to be limited to one or two downlink pumps. Those having skill in the art will be able to devise other types and numbers of downlink pumps without departing from the scope of the invention.

Figure 9:
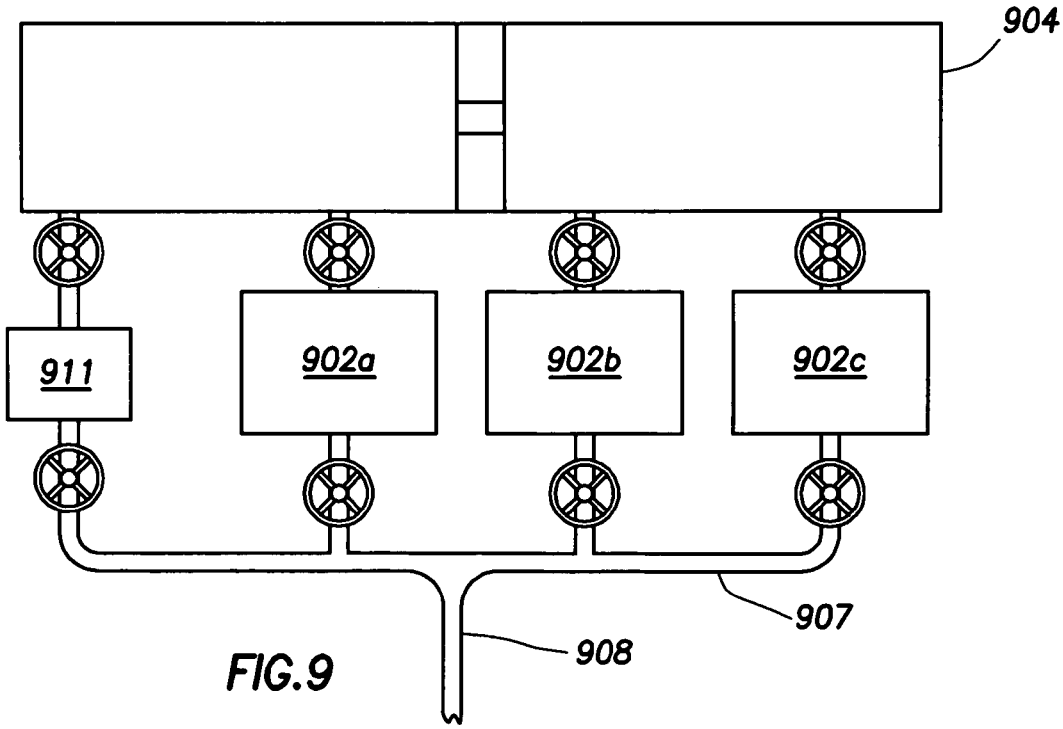
FIG. 9 shows a schematic of a downlink system in accordance with one embodiment of the invention.

FIG. 9 diagrammatically shows another embodiment of a downlink pump 911 in accordance with the invention. The discharge of the downlink pump 911 is connected to the mud manifold 907, and the intake of the downlink pump 911 is connected to the mud tank 904. The downlink pump 911 in this embodiment pumps mud from the mud tank 904 into the mud manifold 907, thereby increasing the nominal flow rate produced by the mud pumps 902*a*, 902*b*, 902*c*.

During normal operation, the downlink pump 911 is not in operation. The downlink pump 911 is only operated when a downlink signal is being sent to the BHA (not shown). The downlink pump 911 may be intermittently operated to create pulses of increased flow rate that can be detected by sensors in the BHA (not shown). These pulses are of an increased flow rate, so the mud flow to the BHA remains sufficient to continue drilling operations while a downlink signal is being sent.

One or more embodiments of a downlink pump may present some of the following advantages. A reciprocating pump enables the control of both the frequency and the amplitude of the signal by selecting the speed and stroke length of the downlink pump. Advantageously, a reciprocating pump enables the transmission of complicated mud pulse signals in a small amount of time.

A pump of this type is well known in the art, as are the necessary maintenance schedules and procedures. A downlink pump may be maintained and repaired at the same time as the mud pumps. The downlink pump does not require additional lost drilling time due to maintenance and repair.

Advantageously, a diaphragm pump may have no moving parts that could wear out or fail. A diaphragm pump may require less maintenance and repair than other types of pumps.

Advantageously, a downlink pump that is coupled to both the mud tanks and the standpipe may operate by increasing the nominal mud flow rate. Thus, there is no need to interrupt drilling operations to send a downlink signal.

In some embodiments, a downlink system includes electronic circuitry that is operatively coupled to the motor for at least one mud pump. The electronic circuitry controls and varies the speed of the mud pump to modulate the flow rate of mud through the drilling system.

One or more of the previously described embodiments of a downlink system have the advantage of being an automated process that eliminates human judgment an error from the downlink process. Accordingly, some of these embodiments include a computer or electronics system to precisely control the downlink signal transmission. For example, a downlink system that includes a modulator may be operatively connected to a computer near the drilling rig. The computer controls the modulator during the downlink signal transmission. Referring again to FIG. 2, the modulator is operatively coupled to a control circuitry 231. Those having skill in the art will realize that any of the above described embodiments may be operatively coupled to a control circuitry, such as a computer.

While the invention has been described with respect to a limited number of embodiments, those skilled in the art, having benefit of this disclosure, will appreciate that other embodiments can be devised that do not depart from the scope of the invention as disclosed herein. Accordingly, the scope of the invention should be limited only by the attached claims.

What is claimed is:

1. A method for generating a downlink signal, comprising:

pumping a drilling fluid from a storage unit to a downhole drilling tool with a pump;

coupling an actuation device to a control panel of the pump;

coupling the actuation device to a pump control device on the pump control panel; and creating a pulse in the drilling fluid flow by selectively controlling the pump control device with the actuation device.

2. The method of claim 1, wherein the creating a pulse is done simultaneous with drilling operations.

3. A method of generating a downlink signal, comprising:

pumping a drilling fluid from a storage unit to a downhole drilling tool using at least one drilling fluid pump having a plurality of pumping elements; and creating a pulse in a drilling fluid flow by selectively reducing the efficiency of at least one of the plurality of pumping elements.

4. A method of generating a downlink signal, comprising:

pumping a drilling fluid from a storage unit to a downhole drilling tool at a nominal flow rate; and selectively alternately increasing and decreasing the mud flow rate of the drilling fluid using a downlink pump having an intake that is in fluid communication with a standpipe and having a discharge that is in fluid communication with the standpipe.

5. A method of generating a downlink signal, comprising:

operating at least one primary drilling fluid pump to pump drilling fluid from a storage unit to a downhole drilling tool; and engaging an electronic circuitry tat is operatively coupled to the at least one primary drilling fluid pump to modulate a speed of the at least one primary drilling fluid pump.

* * * * *